US012595531B2

(12) United States Patent
Fu et al.

(10) Patent No.: US 12,595,531 B2
(45) Date of Patent: Apr. 7, 2026

(54) METHOD OF PREPARING SCANDIUM METAL

(71) Applicant: INDUSTRIAL TECHNOLOGY RESEARCH INSTITUTE, Hsinchu (TW)

(72) Inventors: Sheng-Chun Fu, Kaohsiung City (TW); Yang-Sheng Huang, Kaohsiung City (TW); Chia-Ming Chang, Kaohsiung City (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 800 days.

(21) Appl. No.: 18/071,123

(22) Filed: Nov. 29, 2022

(65) Prior Publication Data

US 2024/0175104 A1 May 30, 2024

(51) Int. Cl.
*C22B 5/02* (2006.01)
*C22B 61/00* (2006.01)

(52) U.S. Cl.
CPC ..... *C22B 5/02* (2013.01); *C22B 61/00* (2013.01)

(58) Field of Classification Search
CPC .. C22B 5/02; C22B 61/00; C22B 5/00; C22B 5/04; C22B 9/04; C22B 59/00; C22B 7/00; C22B 9/006
USPC ..... 423/21.1
See application file for complete search history.

(56) References Cited

FOREIGN PATENT DOCUMENTS

| | | | | |
|---|---|---|---|---|
| CN | 100410400 | C | | 8/2008 |
| CN | 101709394 | A | | 5/2010 |
| CN | 102220502 | A | | 10/2011 |
| CN | 102220503 | A | | 10/2011 |
| CN | 104726712 | A | * | 6/2015 |
| CN | 104928507 | A | | 9/2015 |
| CN | 105803235 | A | | 7/2016 |
| CN | 106086567 | A | | 11/2016 |
| CN | 104746106 | B | | 2/2017 |
| CN | 110306072 | A | | 10/2019 |
| JP | 1-116038 | A | | 5/1989 |
| JP | 1-290723 | A | | 11/1989 |
| JP | 9-324227 | A | | 12/1997 |
| JP | 11-260794 | A | | 9/1999 |
| JP | 2003-171724 | A | | 6/2003 |
| JP | 2018-127665 | A | | 8/2018 |
| RU | 2 034 071 | C1 | | 4/1995 |
| RU | 2 621 207 | C1 | | 6/2017 |
| RU | 2748846 | C1 | * | 5/2021 ..... C22B 59/00 |
| TW | 202212585 | A | | 4/2022 |
| WO | WO 2016/171589 | A1 | | 10/2016 |

OTHER PUBLICATIONS

Harata M. et al., Production of scandium and Al—Sc alloy by metallothermic reduction. Mineral Processing and Extractive Metallurgy. (Year: 2008).*
Machine Translation of CN 104726712 A (Year: 2015).*
Machine Translation of RU 2768846 C1 (Year: 2021).*
Taiwanese Office Action and Search Report for corresponding Taiwanese Application No. 111145570, dated Aug. 15, 2023.
Japanese Office Action for Japanese Application No. 2023-192441, dated Jan. 7, 2024, with an English translation.

* cited by examiner

*Primary Examiner* — Coris Fung
*Assistant Examiner* — Remy Frederic Lalisse
(74) *Attorney, Agent, or Firm* — Birch, Stewart, Kolasch & Birch, LLP

(57) ABSTRACT

A method of preparing scandium metal includes mixing aluminum powder and scandium fluoride powder to form a mixture, heating the mixture in a vacuum environment to react the aluminum powder with the scandium fluoride powder for forming aluminum fluoride gas and scandium metal, and removing the aluminum fluoride gas by evacuation to obtain the scandium metal.

7 Claims, No Drawings

METHOD OF PREPARING SCANDIUM METAL

TECHNICAL FIELD

The technical field relates to a method of preparing scandium metal.

BACKGROUND

There are two existing methods for preparing scandium metal: calciothermic reduction and electrolysis of fused salts. The raw materials needed for calciothermic reduction (such as calcium metal) have a low purity. Moreover, they are difficult to store, and their reaction temperature can change dramatically, thereby resulting in very low purity (lower than 99 wt %) and hence a low yield of the final product. The raw materials used in the electrolysis of fused salt (such as scandium halide) can seriously corrode the electrolysis tank and the electrode material, meaning that this method cannot be used effectively in large-scale industrial production operations.

Accordingly, a novel method for preparing the scandium metal is called for.

SUMMARY

One embodiment of the disclosure provides a method of preparing scandium metal. The method includes mixing aluminum powder and scandium fluoride powder to form a mixture; heating the mixture in a vacuum environment to react the aluminum powder with the scandium fluoride powder for forming aluminum fluoride gas and scandium metal; and removing the aluminum fluoride gas by evacuation to obtain the scandium metal.

In some embodiment, the aluminum powder and the scandium fluoride powder have a weight ratio of 0.27 to 0.4.

In some embodiments, the vacuum environment has a pressure of more than 0.1 Pa and less than 1 Pa.

In some embodiments, the step of heating the mixture includes a first stage and a second stage, wherein the first stage is performed at a temperature of 900° C. to 1500° C., and the second stage is performed at a temperature of 1300° C. to 1800° C.

In some embodiments, the first stage is performed for a period of 20 minutes to 2 hours, and the second stage is performed for a period of 20 minutes to 2 hours.

In some embodiments, the step of heating the mixture is an one-stage process performed at a temperature of 1300° C. to 1500° C. for a period of 40 minutes to 4 hours.

In some embodiments, the scandium metal has a purity of 99 wt % to 100 wt %.

In some embodiments, the method further includes forming a scandium target or a scandium alloy target from the scandium metal.

A detailed description is given in the following embodiments.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details.

One embodiment of the disclosure provides a method of preparing scandium metal. The method includes mixing aluminum powder and scandium fluoride powder to form a mixture. In some embodiment, the aluminum powder and the scandium fluoride powder have a weight ratio of 0.27 to 0.4. If the aluminum powder amount is too low, the purity of the scandium metal will be insufficient. If the aluminum powder amount is too high, the purity of the scandium metal will be insufficient.

Subsequently, the method heats the mixture in a vacuum environment to react the aluminum powder with the scandium fluoride powder for forming aluminum fluoride gas and scandium metal. For example, the reaction of the aluminum powder and the scandium fluoride powder is shown below:

$$Al+ScF_3 \rightarrow AlF_3+Sc$$

The aluminum fluoride may further react with aluminum as below:

$$AlF_3+2Al \rightarrow 3AlF$$

In some embodiments, the vacuum environment has a pressure that is greater than 0.1 Pa and less than 1 Pa. If the pressure of the vacuum environment is too high (i.e. vacuum degree is insufficient), a part of the scandium metal will easily react with oxygen to form scandium oxide, which may hinder the chemical reduction and result in an insufficient purity of the scandium metal product.

Subsequently, the method removes the aluminum fluoride gas (e.g. $AlF_3$ and AlF) by evacuation to obtain the scandium metal. In some embodiments, the scandium metal has a purity of 99 wt % to 100 wt %, which can be used to fabricate a scandium target or a scandium alloy target (such as an aluminum scandium alloy target).

In some embodiments, the step of heating the mixture includes a first stage and a second stage, wherein the first stage is performed at a temperature of 900° C. to 1500° C., and the second stage is performed at a temperature of 1300° C. to 1800° C. In some embodiments, the first stage is performed for a period of 20 minutes to 2 hours, and the second stage is performed for a period of 20 minutes to 2 hours. If the first stage temperature is too low or the first stage period is too short, the reaction of aluminum and fluorine will be incomplete, such that the scandium metal purity will be insufficient. If the first stage temperature is too high or the first stage period is too long, a large amount of aluminum vapor will be generated to cause splash, and the aluminum vapor cannot react with fluorine to form aluminum fluoride. If the second stage temperature is too low or the second stage period is too short, the aluminum fluoride gas cannot be efficiently removed, such that the scandium metal purity will be insufficient. If the second stage temperature is too high or the second stage period is too long, the scandium metal purity will be insufficient.

In some embodiments, the step of heating the mixture is an one-stage process performed at a temperature of 1300° C. to 1500° C. for a period of 40 minutes to 4 hours.

The One-Stage Process may Prepare the Scandium Metal, Too.

Compared to the existing methods for preparing the scandium metal, the method of the disclosure has advantages as below. The aluminum fluoride can be removed by evacuation, it is unnecessary to break vacuum to remove a solid side product. The described method may form a scandium metal of high purity (such as 99 wt % to 100 wt %) without an additional purifying step. The vacuum degree for the vacuum environment of the disclosure is not extremely high, which can be achieved by a general vacuum pump. Moreover, the method of the disclosure is simple and uncomplicated, thereby being favorable for mass production and cost reduction.

Below, exemplary embodiments will be described in detail so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

EXAMPLES

Comparative Example 1 (Too Little Aluminum Powder)

100 g of scandium fluoride ($ScF_3$, commercially available from Uni-Onward Co.) and 26 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1200° C. to perform a first stage reaction for a period of about 20 minutes. After the first stage reaction was completed, the temperature of the reaction chamber was heated to 1400° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 45 g of scandium metal with a purity of 85.2 wt % (determined by EDX). Because the aluminum powder and the scandium fluoride powder had too low of a weight ratio (0.26), the scandium metal had an insufficient purity.

Comparative Example 2 (Too Much Aluminum Powder)

100 g of scandium fluoride ($ScF_3$, commercially available from Uni-Onward Co.) and 45 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1200° C. to perform a first stage reaction for a period of about 20 minutes. After the first stage reaction was completed, the temperature of the reaction chamber was heated to 1400° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 53 g of scandium metal with a purity of 62.0 wt % (determined by EDX). Because the aluminum powder and the scandium fluoride powder had too high of a weight ratio (higher than 0.40), too much aluminum powder could not completely react, such that the scandium metal had an insufficient purity.

Comparative Example 3 (First Stage Reaction Temperature was Too Low)

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 850° C. to perform a first stage reaction for a period of about 20 minutes. After the first stage reaction was completed, the temperature of the reaction chamber was heated to 1300° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 48 g of scandium metal with a purity of 57.0 wt % (determined by EDX). Because the first stage reaction temperature was too low (850° C.), the scandium metal had an insufficient purity.

Comparative Example 4 (Second Stage Reaction Temperature was Too Low)

120 g of scandium fluoride ($ScF_3$, commercially available from Uni-Onward Co.) and 44 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1200° C. to perform a first stage reaction for a period of about 20 minutes. After the first stage reaction was completed, the temperature of the reaction chamber was kept as 1200° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 60 g of scandium metal with a purity of 65 wt % (determined by EDX). Because the second stage reaction temperature was too low (1200° C.), the scandium metal had an insufficient purity.

Comparative Example 5 (First Stage Reaction Temperature was Too High)

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1600° C. to perform a first stage reaction for a period of about 20 minutes. After the first stage reaction was completed, the temperature of the reaction chamber was kept as 1600° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 35 g of scandium metal with a purity of 86 wt % (determined by EDX). Because the first stage reaction temperature was too high (1600° C.), the scandium metal had an insufficient purity. In addition, the first stage reaction temperature was too high, thereby forming a large amount of aluminum vapor to cause splash, and the aluminum vapor could not react with fluorine to form aluminum fluoride.

Comparative Example 6 (Second Stage Reaction Temperature was Too High)

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1200° C. to perform a first stage reaction for a period of about 20 minutes. After the first stage reaction was completed, the temperature of the reaction chamber was heated to 1820° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 40 g of scandium metal with a purity of 97.5 wt % (determined by EDX). Because the second stage reaction temperature was too high (1820° C.), the scandium metal had an insufficient purity.

Comparative Example 7 (Reaction Chamber Pressure was Too High)

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to 5 Pa by an air extraction device, and a heating device was turned on for heating the raw materials in the crucible to 1200° C. to perform a first stage reaction for a period of about 20 minutes. After the first stage reaction was completed, the temperature of the reaction chamber was heated to 1400° C. and the pressure in the reaction chamber was kept as 5 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 44 g of scandium metal with a purity of 72 wt % (determined by EDX). Because the reaction chamber pressure was too high (5 Pa), the scandium metal had an insufficient purity.

Comparative Example 8 (Calcium and Scandium Fluoride)

100 g of scandium fluoride ($ScF_3$, commercially available from Uni-Onward Co.) and 65 g of calcium particles (Ca, commercially available from Uni-Onward Co.) were fully mixed and put into a crucible. The crucible was then put into a reaction chamber. The pressure in the reaction chamber was reduced to 0.01 Pa by an air extraction device, and a heating device was turned on for heating the raw materials in the crucible to 1650° C. to perform a reaction for a period of about 60 minutes. After the reaction was completed, the calcium fluoride solid and the scandium liquid were obviously separated to layers. The calcium fluoride solid was removed, and the scandium liquid was then cooled to obtain 38 g of scandium metal with a purity of 96.3 wt % (determined by EDX). Accordingly, if the aluminum was replaced with calcium to perform the so-called calciothermic reduction, the side product calcium fluoride would be solid and could not be removed by air extraction, and the scandium metal product would have an insufficient purity.

Example 1

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1200° C. to perform a first stage reaction for a period of about 20 minutes. After the first stage reaction was completed, the temperature of the reaction chamber was heated to 1400° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 43 g of scandium metal with a purity of 99.3 wt % (determined by EDX).

Example 2

120 g of scandium fluoride ($ScF_3$, commercially available from Uni-Onward Co.) and 44 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1250° C. to perform a first stage reaction for a period of about 20 minutes. After the first stage reaction was completed, the temperature of the reaction chamber was heated to 1500° C. and the pressure in the reaction chamber was kept to less than 1 Pa to perform a second stage reaction for a period of about 25 minutes. After the second stage reaction was completed, the heating device was turned off and the air extraction device was turned on and allowed to run continuously to remove aluminum fluoride gas. The reaction chamber was then cooled to room temperature to obtain 50 g of scandium metal with a purity of 99.5 wt % (determined by EDX).

Example 3

150 g of scandium fluoride ($ScF_3$, commercially available from Uni-Onward Co.) and 52 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1400° C. to perform a first stage reaction for a period of about 25 minutes. After the first stage reaction was completed, the temperature of the reaction chamber was heated to 1500° C. and the pressure in the reaction chamber was kept to less than 1 Pa to perform a second stage reaction for a period of about 30 minutes. After the second stage reaction was completed, the heating device was turned off and the air extraction device was turned on and allowed to run continuously to remove aluminum fluoride gas. The reaction chamber was then cooled to room temperature to obtain 62 g of scandium metal with a purity of 99.2 wt % (determined by EDX).

Example 4

150 g of scandium fluoride ($ScF_3$, commercially available from Uni-Onward Co.) and 52 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1400° C. to perform a first stage reaction for a period of about 25 minutes. After the first stage reaction was completed, the temperature of the reaction chamber was kept as 1400° C. and the pressure in the reaction chamber was kept to less than 1 Pa to perform a second stage reaction for a period of about 30 minutes. After the second stage reaction was completed, the heating device was turned off and the air extraction device was turned on and allowed to run continuously to remove aluminum fluoride gas. The reaction chamber was then cooled to room temperature to obtain 55 g of scandium metal with a purity of 99.1 wt % (determined by EDX).

Example 5

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 900° C. to perform a first stage reaction for a period of about 80 minutes. After the first stage reaction was completed, the temperature of the reaction chamber was heated to 1400° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 41 g of scandium metal with a purity of 99.2 wt % (determined by EDX).

Example 6

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1200° C. to perform a first stage reaction for a period of about 20 minutes. After the first stage reaction was completed, the temperature of the reaction chamber was heated to 1800° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 39 g of scandium metal with a purity of 99.4 wt % (determined by EDX).

Example 7

100 g of scandium fluoride ($ScF_3$, commercially available from Uni-Onward Co.) and 29 g of aluminum powder (Al, commercially available from Uni-Onward Co.) were fully mixed and put into a crucible. The crucible was then put into a reaction chamber. The pressure in the reaction chamber was reduced to less than 1 Pa by an air extraction device, and a heating device was turned on for heating the raw materials in the crucible to 1450° C. to perform a first stage reaction for a period of about 20 minutes. After the first stage reaction was completed, the temperature of the reaction chamber was cooled to 1350° C. and the pressure in the reaction chamber was kept to less than 1 Pa to perform a second stage reaction for a period of about 20 minutes. After the second stage reaction was completed, the heating device was turned off and the air extraction device was turned on and allowed to run continuously to remove aluminum fluoride gas. The reaction chamber was then cooled to room temperature to obtain 40 g of scandium metal with a purity of 99.2 wt % (determined by EDX).

It will be apparent to those skilled in the art that various modifications and variations can be made to the disclosed methods and materials. It is intended that the specification and examples be considered as exemplary only, with the true scope of the disclosure being indicated by the following claims and their equivalents.

What is claimed is:

1. A method of preparing scandium metal, comprising:

mixing aluminum powder and scandium fluoride powder to form a mixture;

heating the mixture in a vacuum environment to react the aluminum powder with the scandium fluoride powder for forming aluminum fluoride gas and scandium metal; and removing the aluminum fluoride gas by evacuation to obtain the scandium metal, wherein the scandium metal has a purity of 99 wt % to 100 wt %.

2. The method as claimed in claim 1, wherein the aluminum powder and the scandium fluoride powder have a weight ratio of 0.27 to 0.4.

3. The method as claimed in claim 1, wherein the vacuum environment has a pressure of more than 0.1 Pa and less than 1 Pa.

4. The method as claimed in claim 1, wherein the step of heating the mixture includes a first stage and a second stage, wherein the first stage is performed at a temperature of 900° C. to 1500° C., and the second stage is performed at a temperature of 1300° C. to 1800° C.

5. The method as claimed in claim 4, wherein the first stage is performed for a period of 20 minutes to 2 hours, and the second stage is performed for a period of 20 minutes to 2 hours.

6. The method as claimed in claim 1, wherein the step of heating the mixture is an one-stage process performed at a temperature of 1300° C. to 1500° C. for a period of 40 minutes to 4 hours.

7. The method as claimed in claim 1, further comprising forming a scandium target or a scandium alloy target from the scandium metal.

* * * * *